United States Patent [19]

Nimura et al.

[11] Patent Number: 4,768,435

[45] Date of Patent: Sep. 6, 1988

[54] LABEL PRINTER APPARATUS

[75] Inventors: Hitoshi Nimura; Takayasu Mizuguchi; Yuji Takahashi; Kiyomichi Nagashima, all of Shizuoka, Japan

[73] Assignee: Tokyo Electric Co., Ltd., Tokyo, Japan

[21] Appl. No.: 51,589

[22] Filed: May 20, 1987

[30] Foreign Application Priority Data

May 26, 1986 [JP] Japan ..... 61-79228[U]

[51] Int. Cl.[4] ..... B41J 15/22; B41L 21/12

[52] U.S. Cl. ..... 101/66; 101/348; 156/DIG. 33; 156/DIG. 47; 400/79; 400/82

[58] Field of Search ..... 156/30, 33, 47, 50; 400/71, 82; 101/66, 348, 349

[56] References Cited

U.S. PATENT DOCUMENTS

| | | | |
|---|---|---|---|
| 2,105,948 | 1/1938 | Melhman | 101/66 |
| 3,944,455 | 3/1976 | French | 156/D33 |
| 4,022,124 | 5/1977 | Knudsen | 101/348 |
| 4,057,015 | 11/1977 | Kodis | 101/349 |
| 4,432,830 | 2/1984 | Jue | 156/D47 |
| 4,516,208 | 5/1985 | Sakura et al. | 364/466 |
| 4,547,250 | 10/1985 | Murayama | 156/D47 |
| 4,560,292 | 12/1985 | Takahashi | 156/D47 |
| 4,638,332 | 1/1987 | Sakura et al. | 346/76 PH |
| 4,639,743 | 1/1987 | Sakura et al. | 346/76 PH |
| 4,641,147 | 2/1987 | Sakura et al. | 346/76 PH |

FOREIGN PATENT DOCUMENTS

| | | | |
|---|---|---|---|
| 195949 | 10/1986 | European Pat. Off. | 400/82 |
| 123676 | 7/1984 | Japan | 400/82 |
| 206960 | 11/1923 | United Kingdom | 101/66 |
| 496900 | 12/1938 | United Kingdom | 101/66 |

*Primary Examiner*—Clyde I. Coughenour

*Attorney, Agent, or Firm*—Oblon, Fisher, Spivak, McClelland & Maier

[57] ABSTRACT

The invention provides a printer apparatus which comprises a pair of doors mounted for opening and closing movement on opposite sides of a body case in the form of a housing, a printer located inside each of the doors for receiving elongated continuous print paper therein in such a manner as to allow the print paper toward the door and for printing on the thus received print paper, and a pair of issuing openings located on opposite side portions of a front wall of the body case for issuing therefrom the print paper after printing by the printers. Thus, two different types of print paper can be set in position in and printed by the two printers, which reduces the necessity of frequent label exchanging operations. Besides, an operation for exchanging print paper for each of the printers can be performed readily by opening the door for the printer.

5 Claims, 4 Drawing Sheets

LABEL PRINTER APPARATUS

FIELD OF THE INVENTION

This invention relates to a printer apparatus for printing on elongated continuous print paper, and particularly to a printer apparatus suitable for printing on two different types of print paper.

BACKGROUND OF THE INVENTION

Among various printers for printing on print paper, there is a label printer for printing information of predetermined matters on one after another of a plurality of labels which are applied, for example, in a predetermined spaced relationship to elongated continuous ground paper. A printer of this type conventionally includes a set of a supply device for holding a would roll of elongated continuous ground paper therein, a platen, a print head, a take-up device for winding ground paper thereon, and so on. In the printer, ground paper is fed from the supply device to the platen, and a label on the ground paper is printed on the platen by the print head. After printing, the label is exfoliated from the ground paper and issued at a predetermined position while the ground paper is wound up by the take-up device.

Now, problems of such a prior art arrangement will be described. There are predetermined standards for labels, and within such standards, there are various types of labels which are different in color and/or size. Accordingly, labels of different types may actually have to be printed by the label printer. However, each time labels to be printed are to be exchanged for labels of a different type, different ground paper must be remounted on this supply device, which is a troublesome operation. In addition to the defect, it is also defective that a printer is not designed for use other than for issuing labels.

OBJECTS OF THE INVENTION

It is a first object of the present invention to provide a printer apparatus which can print on a plurality of types of labels without the necessity of frequent exchanging operations.

It is a second object of the invention to provide a printer apparatus which can print on elongated continuous print paper in addition to labels.

It is a third object of the invention to provide a label printer apparatus wherein an operation for exchanging print paper can be performed readily.

It is a fourth object of the invention to provide printer apparatus wherein a large number of parts can be used commonly.

SUMMARY OF THE INVENTION

In order to attain the objects, according to the present invention, there is provided a printer apparatus which comprises a pair of doors mounted for opening and closing movement on opposite sides of a body case in the form of a housing, a printer is located inside each of the doors within the body case for receiving elongated continuous print paper therein in such a manner as to allow the print paper toward the door and for printing on the thus received print paper. A pair of issuing openings is located on opposite side portions of a front wall of the body case for issuing therefrom the print paper after printing by the printers. Accordingly, two different types of print paper can be set in position in and printed by the two printers, which eliminates the necessity of frequent label exchanging operations. Besides, an operation for exchanging print paper for each of the printers can be performed readily by opening the door for the printer. This is because the print paper is held in such a manner that it can be removed directly from the printer if the door is opened.

Further, a large number of parts can be used in common if the printer apparatus further comprises a pair of left and right printer mounting plates located in an opposing and spaced relationship by a predetermined distance inside the doors. Each of the printer mounting plates has formed thereon a pair of supply devices for holding a wound roll of the print paper thereon, pairs of mounting means for mounting a thermal head and a platen thereon, and a pair of securing means for securing the printer mounting plate to the body case, the supply means, the mounting means and the securing means of each of the printer mounting plates being located at symmetrical positions of the printer mounting plate relative to each other with respect to a predetermined imaginary dividing line which passes the center of the printer mounting plate.

DESCRIPTION OF THE PREFERRED EMBODIMENT

Figure 1:
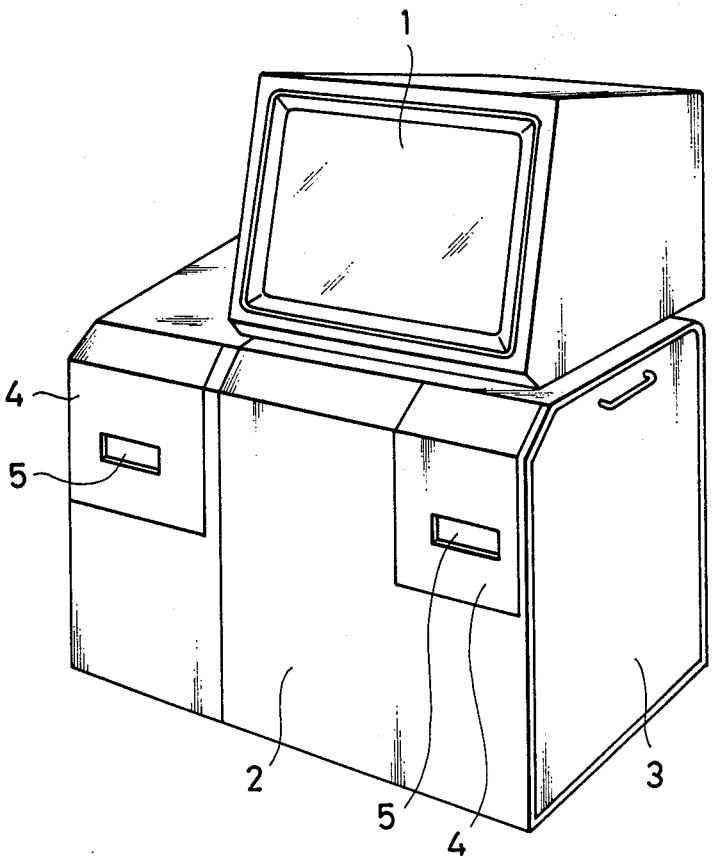
FIG. 1 is a perspective view of an entire printer apparatus showing an embodiment of the present invention.

An embodiment of the present invention will be described with reference to FIGS. 1 to 4. As shown in FIG. 1, a printer apparatus shown includes a housing 2 serving as a body case on which a display 1 is placed. The housing 2 has a pair of doors or covers 3 mounted for opening and closing movement on opposite left and right sides thereof. The housing 2 further has a pair of front panels 4 secured at opposite locations of a front wall thereof. Each of the front panels 4 has formed therein an issuing opening 5 for issuing a label or a receipt therefrom.

Figure 2:
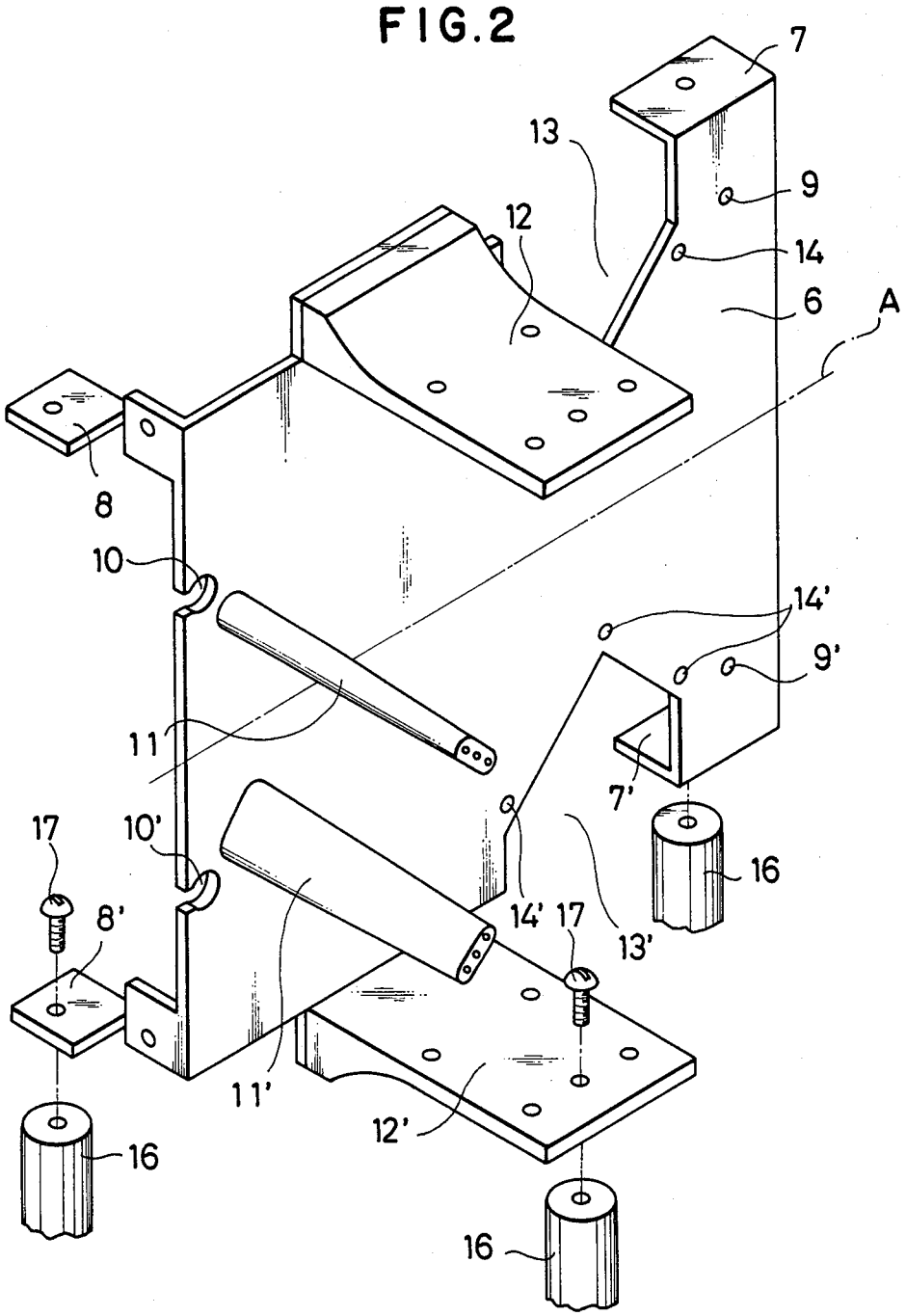
FIG. 2 is a perspective view of one of a pair of printer mounting plates of the printer apparatus of FIG. 1.

Turning to FIG. 2, a pair of printer mounting plates 6 are secured within the housing 2 in an opposing and spaced relationship by a predetermined distance inside the covers 3. One of the printer mounting plates 6 is shown in FIG. 2. Each of the printer mounting plates 6 has formed thereon two pairs of upper and lower securing pieces 7, 7' and 8, 8' which serve as securing means, and pairs of upper and lower mounting holes 9, 9', 10, 10' and 14, 14', recesses 13, 13', and beams 11, 11' which all serve as mounting means. Each of the printer mounting plates 6 has a pair of upper and lower mounting plates 12, 12' formed thereon which serve as securing means and also as mounting means. Thus, each of the printer mounting plates 6 has a symmetrical geometry with respect to a predetermined imaginary dividing line A which passes the center of printer mounting plate 6.

Figure 3:
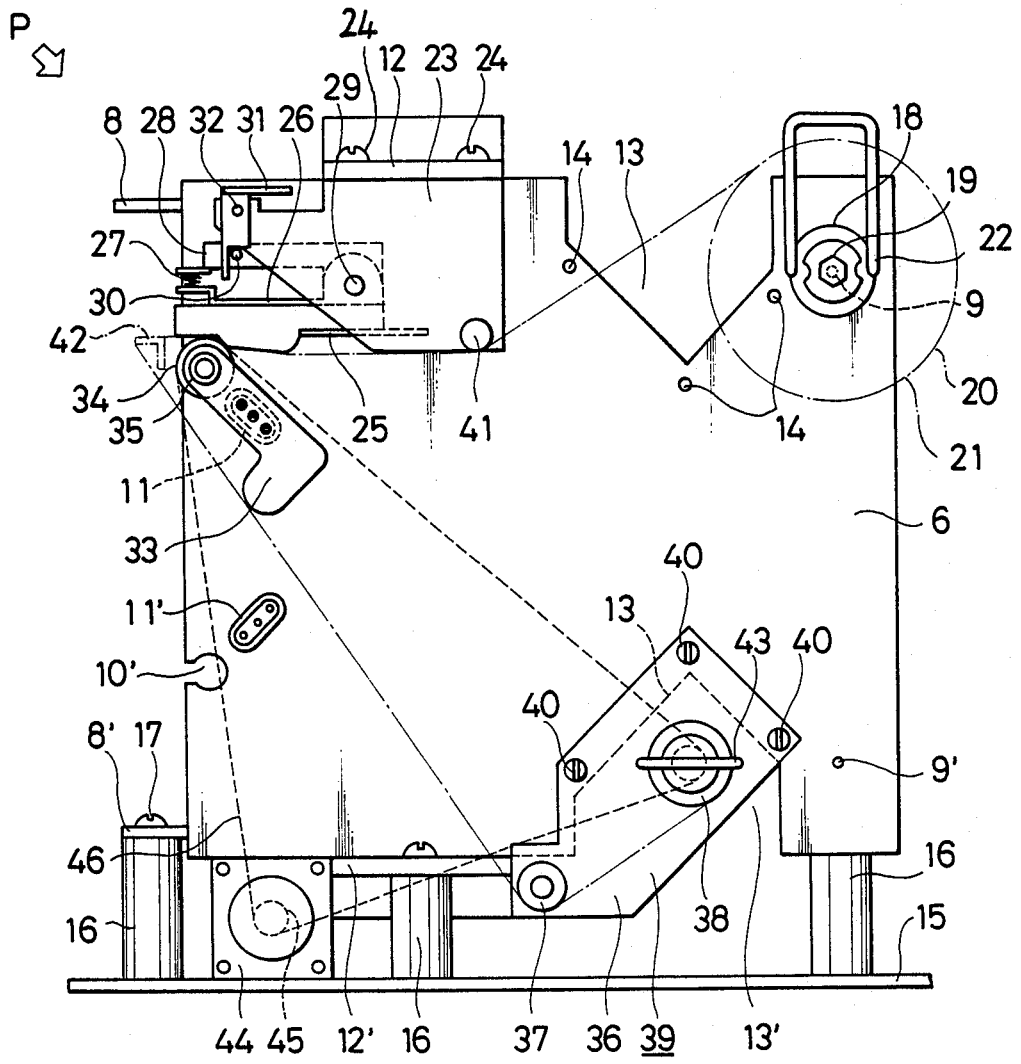
FIG. 3 is a side elevational view of the right-hand side printer mounting plate of the printer apparatus of FIG. 1 on which various parts are mounted.
Figure 4:
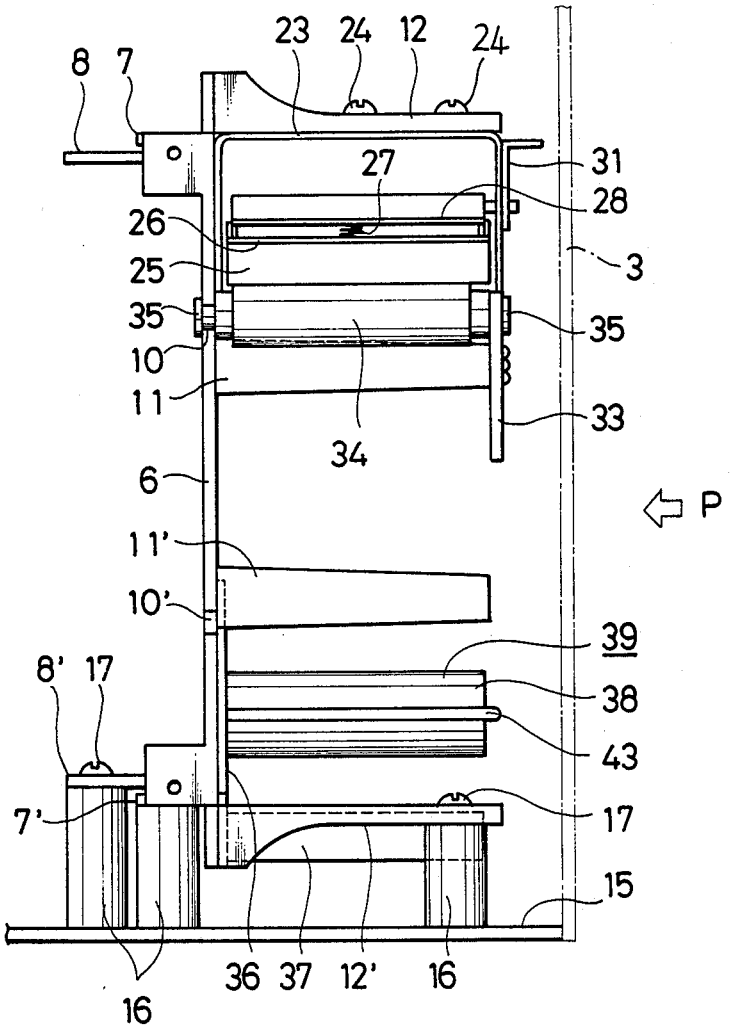
FIG. 4 is a front elevational view of the right-hand side printer mounting plate of FIG. 3.

One of the printer mounting plates 6 which is located on the right-hand side where the display 1 is viewed from its front is secured by fastening, by means of screws 17, the lower securing pieces 7', 8' and the lower mounting plate 12' to bosses 16 secured to a base 15 as shown in FIGS. 3 and 4. A printer P is mounted on the right-hand side printer mounting plate 6. The printer P here denotes the whole of various printer components, and the right-hand side printer mounting plate 6 is located within the housing 2 such that the printer components may be oriented to the cover 3 when mounted as apparently seen from FIGS. 3 and 4.

Subsequently, mounting of the printer components on the right-hand side printer mounting plate 6 will be described. A tubular supply shaft 18 serving as a supply device is secured to the upper mounting hole 9 by means of a bolt 19. Elongated continuous ground paper 21 having a large number of labels 20 applied in an equidistantly spaced relationship thereto is wound around and held on the supply shaft 18. A wire 22 for pressing against a lateral end of a wound roll of the ground paper 21 is also provided on the supply shaft 18.

A downwardly opened channel-shaped frame 23 is secured to the upper mounting plate 12 by means of a pair of screws 24. A head plate 26 to which a thermal head 25 is secured and a pressing plate 28 for receiving an urging force of a spring 27 to press the head plate 26 downwardly are mounted for pivotal motion on the frame 23 by means of a shaft 29. Further, an engaging piece 31 for engaging with a pin 30 extending from a side of the pressing plate 28 is mounted for pivotal motion on a side of the frame 23 by means of a shaft 32.

A bearing supporting piece 33 is screwed at an end of the upper beam 11, and a bearing 35 for supporting an end portion of a platen 34 is held by the supporting piece 33 and the mounting hole 10 of the printer mounting plate 6.

Further, a take-up device 39 is fastened to the mounting holes 14' by means of screws 40 and includes a guide roller 37 and a take-up shaft 38 both mounted for rotation on a support plate 36. The recess 13 is provided to allow the take-up shaft 38 to extend therethrough toward a rear side of the printer mounting plate 6. Thus, ground paper 21 drawn out from the supply shaft 18 is first guided along a route defined by a guide roller 41 mounted on the frame 23 to a position between the thermal head 25 and the platen 34, then along a bent route defined by a label exfoliating member 42 secured within the housing 2, and then along a route defined by the guide roller 37, and is then wound onto the take-up shaft 38 and held by a wire 43.

A pair of motors 44 are secured to the base 15 in an opposing relationship under lower edges of the left and right printer mounting plates 6. A timing belt 46 extends around a pulley 45 directly secured to each of the motors 44, another pulley (not shown) secured to the take-up shaft 38 on the rear side of the associated printer mounting platen 6, and a further pulley (not shown) secured to an end portion of the plate 34.

As described hereinabove, each of the printer mounting plates 6 has a symmetrical geometry with respect to the imaginary dividing line A described above. Accordingly, by securing the securing pieces 7', 8' and the mounting plate 12' to the base 15, the printer mounting plates 6 can be arranged in a left and right symmetrical relationship within the housing 2. Though not shown, in the left-hand side printer mounting plate 6, a supply shaft 18 is fastened to the mounting hole 9', and a frame 23 for carrying a head plate 26, a pressing plate 28, and so on thereon is mounted on the mounting plate 12' while a platen 34 is fastened to the mounting hole 10' and a bearing supporting piece 33 secured to the beam 11', and a take-up device 39 is fastened to the mounting hole 14. Accordingly, the arrangement of the various components on the left-hand side printer mounting plate 6 is just symmetrical to that of the like components on the right-hand side printer mounting plate 6 shown in FIGS. 3 and 4 with respect to the aforementioned imaginary dividing line A.

It is to be noted that the left and right issuing openings 5 of the front panels 4 are formed in an opposing relationship to the left and right platens 34, respectively.

With the construction described above, when printing is to be performed by one of the printers P, the thermal head 25 of the same is pressed against a label 20 on the platen 34 by the pressing plate 28 urged by the spring 27. In such a printing step, if the motor 44 is energized, the ground paper 21 is drawn out from the supply shaft 18 and would up onto the take-up shaft 38. Since in this instance the ground paper 21 is bent by the label exfoliating member 42 under predetermined tension, the label 20 is exfoliated from the ground paper 21 and thus issued from the issuing opening 5.

In this manner, a pair of printers P including the thermal head 25 and the platen 34 as principal components are carried on the left and right printer mounting plates 6. Accordingly, different rolls of ground paper to which labels 20 of different sizes or colors are applied, or of receipt paper, journal paper and so on, can be set to the left and right printers so that one or both of the left and right print paper may be printed. Accordingly, even when different types of print paper are to be printed, it is not necessary to perform a print paper exchanging operation so frequently. Besides, print paper can be changed readily by opening the cover 3. This is because print paper is held in such a manner that it can be removed directly from the printer toward the cover 3 if the cover 3 is opened. Such a carrying condition of print paper is similar when either of the left and right covers 3 is opened.

Further, in assembling the entire arrangement, a large number of components can be commonly used for the left and right printer mounting plates 6 because the two printer mounting plates 6 have a symmetrical geometry.

In addition, while the mounting plates 12, 12' are carried in a cantilever-like condition on a printer mounting plate 6, they have a high strength as beams and a high supporting strength for the frames 23 because they have such a structure that they are thick at their base portions and become thinner towards the free ends thereof. Similarly, the beams 11, 11' have a similar structure such that they are thick at their base portions and become thinner towards the free ends thereof. Accordingly, they can sufficiently stand loads applied to end portions thereof. Therefore, the platens 34 can be carried at opposite ends thereof by the printer mounting plates 6 and the bearing supporting pieces 33 secured at the ends of the beams 11, 11'.

It is to be noted that, when the present invention is reduced to practice, each of the printer mounting plates 6 may be formed otherwise—for example, to have a symmetrical geometry with respect to a vertically extending imaginary dividing line or else with respect to an inclined imaginary dividing line. Here, in any case, an imaginary dividing line passes through the center of the printer mounting plate 6.

What is claimed is:

1. A printer apparatus comprising:

(a) a housing comprising:

(i) a first door mounted for opening and closing movement;

(ii) a second door mounted for opening and closing movement;

(iii) a first issuing opening located adjacent to said first door; and (iv) a second issuing opening located adjacent to said second door;

(b) a first printer mounting plate removably secured within said housing in parallel spaced relationship to said first door, said first printer mounting plate having a first side facing said first door and a second side facing away from said first door;

(c) a second printer mounting plate removably secured within said housing in parallel spaced relationship to said second door, said second printer mounting plate having a first side facing said second door and a second side facing away from said second door;

(d) a first printer removably mounted on the first side of said first printer mounting plate;

(e) a second printer removably mounted on the first side of said second printer mounting plate;

(f) a first support shaft for a roll of material to be printed removably mounted on the first side of said first printer mounting plate;

(g) a second support shaft for a roll of material to be printed removably mounted on the first side of said second printer mounting plate;

(h) a first take-up device removably mounted on the first side of said first printer mounting plate; and (i) a second take-up device removably mounted on the first side of said second printer mounting plate, wherein:

(j) said first and second printer mounting plates are identical to each other and (k) each of said first and second printer mounting plates is symmetrical about an imaginary dividing line that passes through its center, whereby the first and second mounting plates can be interchanged and a large number of components can be made commonly for said first and second mounting plates.

2. A printer apparatus as recited in claim 1 and further comprising a display unit mounted on said housing.

3. A printer apparatus as recited in claim 1 wherein:

(a) said housing is symmetrical about a vertical central plane and (b) said first door is located on one side of said vertical central plate and said second door is located on the other side of said vertical central plane.

4. A printer apparatus as recited in claim 1 wherein said imaginary dividing line is not horizontal.

5. A printer apparatus as recited in claim 1 wherein each of said first and second printer mounting plates comprises:

(a) two pairs of securing means, one of each pair of securing means being located on each side of said imaginary dividing line, said securing means serving to secure said first and second printer mounting plates inside said housing;

(b) two first mounting holes, one first mounting hole being located on each side of said imaginary dividing line, one of said first mounting holes serving to removably mount a corresponding one of said first and second support shafts;

(c) two second mounting holes, one second mounting hole being located on each side of said imaginary dividing line, one of said second mounting holes serving to removably mount a platen that is a component of a corresponding one of said first and second printer; and (d) two groups of third mounting holes, one of said groups of third mounting holes being located on each side of said imaginary dividing line, one of said groups of third mounting holes serving to removably mount a corresponding one of said first and second take-up devices.

* * * * *